United States Patent [19]

Van Becelaere

[11] Patent Number: 4,848,653

[45] Date of Patent: Jul. 18, 1989

[54] RIDGE VENT WITH SHAPE-MEMORY ACTUATED HEAT VALVE

[75] Inventor: Robert M. Van Becelaere, Prairie Village, Kans.

[73] Assignee: Philips Industrial Components Inc., Dayton, Ohio

[21] Appl. No.: 103,695

[22] Filed: Oct. 2, 1987

[51] Int. Cl.[4] ..... F24F 7/02

[52] U.S. Cl. ..... 236/49.3; 98/42.18; 98/42.2; 236/101 D

[58] Field of Search ..... 98/42.16, 42.17, 42.18, 98/42.2; 236/49 B, 101 D

[56] References Cited

U.S. PATENT DOCUMENTS 2,266,261 12/1941 Pfeifer, Jr. ..... 98/42.2 X
4,123,001 10/1978 Kult ..... 236/49
4,523,605 6/1985 Ohkata ..... 236/101 D X
4,597,324 7/1986 Spilde ..... 98/42.16

OTHER PUBLICATIONS

*Scientific American.* Nov., 1979, pp. 74–82, re Shape-Memory Alloys.

*Primary Examiner*—Harold Joyce
*Attorney, Agent, or Firm*—Kokjer, Kircher, Bradley, Wharton, Bowman & Johnson

[57] ABSTRACT

An improved actuator for the damper of a ridge vent. The actuator includes coil springs constructed from a shape-memory alloy. The springs are contracted below a selected temperature at which the damper is to open, and the contracted springs maintain the damper closed on its seat. Above the transformation temperature of the springs, they expand and raise the damper off of its seat to an open position for venting of air through the ridge vent.

6 Claims, 1 Drawing Sheet

RIDGE VENT WITH SHAPE-MEMORY ACTUATED HEAT VALVE

BACKGROUND AND SUMMARY OF THE INVENTION

This invention relates generally to ventilation equipment and more particularly to a ridge vent having a damper which is opened and closed by temperature sensitive springs constructed of a shape-memory alloy.

Ridge vents have long been used to provide ventilation at ridges and other areas of the roofs of industrial, commercial, residential, institutional and other buildings. The type of ridge vent that is typically employed on industrial and commercial buildings includes a sheet metal housing equipped with a damper that serves as a valve to control the discharge of air through a ventilation passage. The damper is opened and closed by an actuator that is usually either a chain operated mechanism or an electric motor actuator. The actuator is operated to open the damper when it is desired to vent hot air from the ceiling area of the building and to close the damper when there is no need for ventilation.

This conventional ridge vent construction has several shortcomings which have detracted from its ability to reliably perform its intended function. Normally, it is necessary for someone to initiate the operation of the actuator, and this does not always occur at appropriate times. For example, the damper may be accidentally left open in cold weather so that heated air is able to escape in large quantities, thus increasing the heating requirements of the building. Conversely, the damper may not be opened when ventilation is necessary, and the ceiling area temperature may become excessive before it is recognized that the damper should be opened.

The various chain and motor actuators that have been used in the past are relatively costly and add significantly to the overall cost of the ridge vent. They also include a number of gears and other mechanical components that complicate the mechanism and are subject to the usual mechanical problems such as wear. Because of the inaccessible location of the ridge vent, mechanical breakdowns and other problems with the actuator are at best difficult to repair, and the actuator components are likewise difficult to inspect if they can be inspected at all.

Therefore, it is evident that a need exists for a ridge vent in which the damper actuator is simple, economical, reliable and automatic. It is the principal goal of the present invention to provide such an actuator.

More specifically, it is an important object of the invention to provide a ridge vent having a damper actuator that automatically opens and closes the damper at a selected temperature in order to ventilate when necessary and avoid undue escape of inside air when there is no need for ventilation. Among the other objects of the invention are to provide a damper actuator which is constructed simply and economically, which is devoid of mechanical parts that are subject to wear, and which operates reliably without the need for external power.

In accordance with the invention, the damper of a ridge vent is mounted on specially constructed coil springs which are formed from a shape-memory alloy. The shape-memory alloy is processed such that it exhibits temperature sensitive characteristics which cause the springs to be contracted at temperature levels below a selected temperature at which it is desired for the damper to close, and to expand when the temperature rises above the selected level. The damper is mounted on the springs, and the springs maintain the damper in its closed position when the springs are contracted and in its open position when the springs are expanded. Consequently, the damper automatically opens at temperatures above the selected temperature level and closes at lower temperatures.

The shape-memory alloy actuator is more economical than the actuators that have been used in the past to control the dampers of ridge vents, and it is much simpler. There is no need to make adjustments of the actuator after the ridge vent has been installed, and the actuator lacks mechanical parts that can wear out or otherwise malfunction. Spring fatigue is not a significant problem because chemical changes in the alloy rather than mechanical forces cause the springs to expand and contract. A particularly important advantage is the reliable automatic operation of the actuator in response to the sensed temperature.

DETAILED DESCRIPTION OF THE INVENTION

In the accompanying drawing which forms a part of the specification and is to be read in conjunction therewith and in which like reference numerals are used to indicate like parts in the various views.

Figure 1:
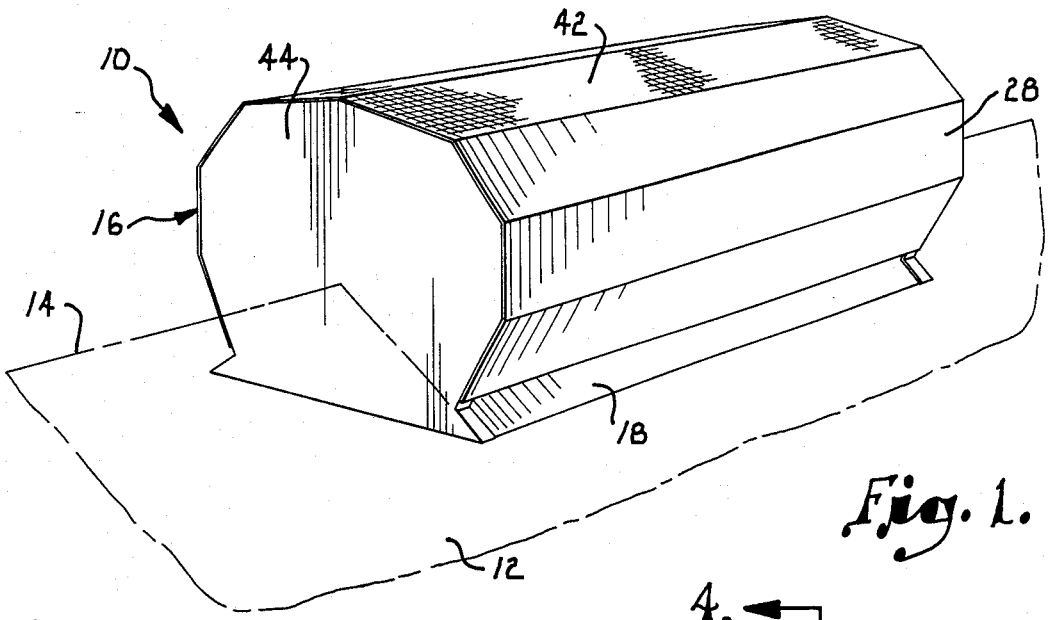
FIG. 1 is a perspective view of a ridge vent which is equipped with a damper actuator constructed according to a preferred embodiment of the present invention, with the ridge vent mounted on a roof peak shown in phantom lines.

Referring now to the drawing in more detail, numeral 10 generally designates a ridge vent of the type that may be mounted on a roof 12 of an industrial, commercial or institutional building. The ridge vent 10 is shown mounted on a ridge or peak 14 of the roof 12, but it should be understood that the ridge vent can be mounted on a flat roof or any other type of roof at the desired location.

The ridge vent 10 has a housing which is generally designated by numeral 16 and which may be constructed of sheet metal or another suitable material. The housing 16 includes at its base a pair of inclined plates 18 which converge as they extend upwardly. The space between the plates 18 provides an inlet 20 which is exposed to the interior of the building at a location immediately below the roof 12. Plates 18 have upturned top edges 22 which extend parallel to one another along the length of the housing 16 and cooperate to form a damper seat on which a damper 24 may be seated. The opposite side edges of damper 24 have downturned flanges **24*a* which overlap edges 22 when the damper is seated. The inlet 20 has a Venturi shape with a restricted throat 26 formed between the edges 22**.

Figure 2:
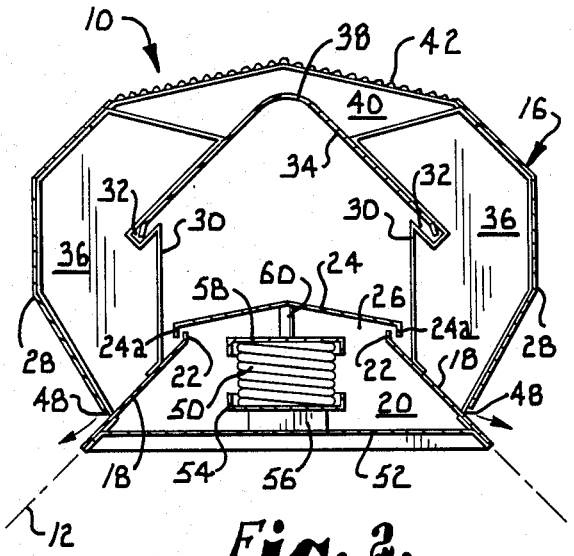
FIG. 2 is a sectional view of the ridge vent taken on a vertical plane, with the damper in its closed position.

The opposite sides 28 of housing 16 are mirror images of one another and are each formed by a sheet metal panel which is bent in two places. Skeletal support for the sides 28 is provided by a plurality of spaced apart metal straps 30 which are each bent into a compound shape best illustrated in FIGS. 2 and 3. The metal straps 30 are supported on and extend generally upwardly from panels 18 on the opposite sides of the housing. The straps 30 on opposite sides of the housing are bent to provide pockets or grooves 32 which open generally upwardly. Received in the grooves 32 are the flanged edges of an L-shaped ridge panel 34 which is thereby supported on the straps 30. The ridge panel 34 is elevated well above the damper seat provided by edges 22 and is spaced inwardly from the sides 28 of the housing to provide a flow passage 36 between each side of the ridge panel and each side 28 of the housing. The sides of the ridge panel coverage as they extend upwardly and are joined at a peak 38 which extends along the transverse center of housing 16 near its top.

An outlet 40 is formed in housing 16 and extends along the length of the housing between the upper edges of the sides 28. The outlet 40 is covered by a screen 42 which is secured at its opposite side edges to the sides 28. Screen 42 prevents the entry of birds, animals and debris into the housing.

The opposite ends of housing 16 are covered by end panels 44 each having an inturned flange 46 (See FIG. 4) to facilitate connection of the end panels with the remainder of the housing. Drain openings in the form of slots 48 are provided at the lower edge of each side 28 and above plates 18 in order to drain off any water that enters the outlet 40 and drains down along the sides of the ridge panel 44. The lower edge portions of panels 18 project below and outwardly of the lower edges of the sides 28 and generally overlie the roof 12.

In accordance with the present invention, the damper 24 is moved between its open and closed positions by an actuator which includes a pair of specially constructed coil springs 50. Each spring 50 is formed from a special shape-memory alloy which is also referred to as a marmem alloy. The springs 50 are specially processed in a manner that is well known to those familiar with shape-memory alloys. The springs are treated such that they assume the contracted condition shown in FIG. 2 when they are at a temperature below a predetermined transition level (such as 95° F., for example). When the springs are at or above the transition temperature level, they expand and assume the expanded condition shown in FIGS. 3 and 4. The springs 50 can be constructed of various metals, but they are preferably a ternary alloy containing copper, zinc, and aluminum. It is noted that the shape-memory processing and composition of the alloy can be adjusted in order to achieve virtually any desired transformation temperature at which the springs expand.

The springs 50 are supported on mounting plates 52 located adjacent to the opposite ends of the housing 16. Each plate 52 is horizontal and includes angled flanges along its opposite edges which are secured to the lower edges of the side plates 18. The lower end of each spring 50 is received and secured to a cup shaped spring retainer 54 mounted on a pad 56 which is in turn secured to the mounting plate 52. The springs are mounted with their central axes oriented vertically.

The upper end of each spring 50 is received in and secured to an upper retainer 58 having an inverted cup shape. Short bars 60 extend vertically from the centers of the upper retainers 58 and connect at their upper ends with the damper 24 near its opposite ends. The springs 50 are located adjacent to the inlet 20 to the housing and are thus exposed to the temperature of the air inside of the building in the vicinity of the peak.

In use, the ridge vent 10 is suitably installed on the roof 12 at the peak 14 or another part of the roof 12. When the temperature of the springs 50 is below the transformation temperature (95° F. in a preferred embodiment of the invention), each spring assumes its contracted condition, and the damper 24 is seated on the edges 22 in its closed position. Then, the damper blocks air flow from the inlet into the passages 36, and the air is not able to flow through the housing 16.

Figure 3:
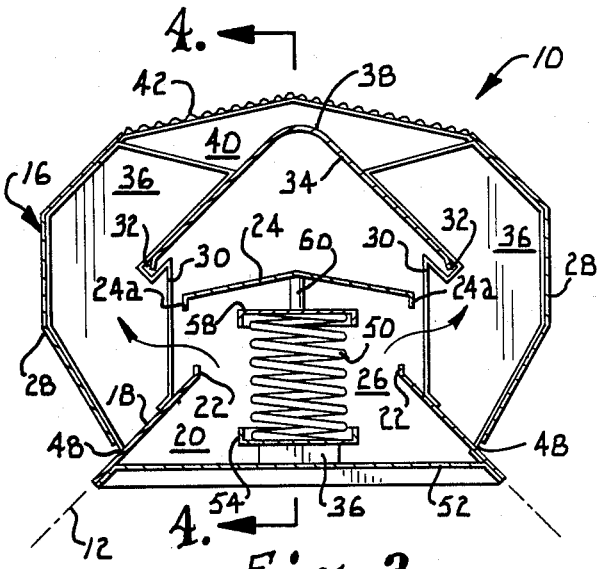
FIG. 3 is a sectional view similar to FIG. 2, but showing the damper raised to its open position.
Figure 4:
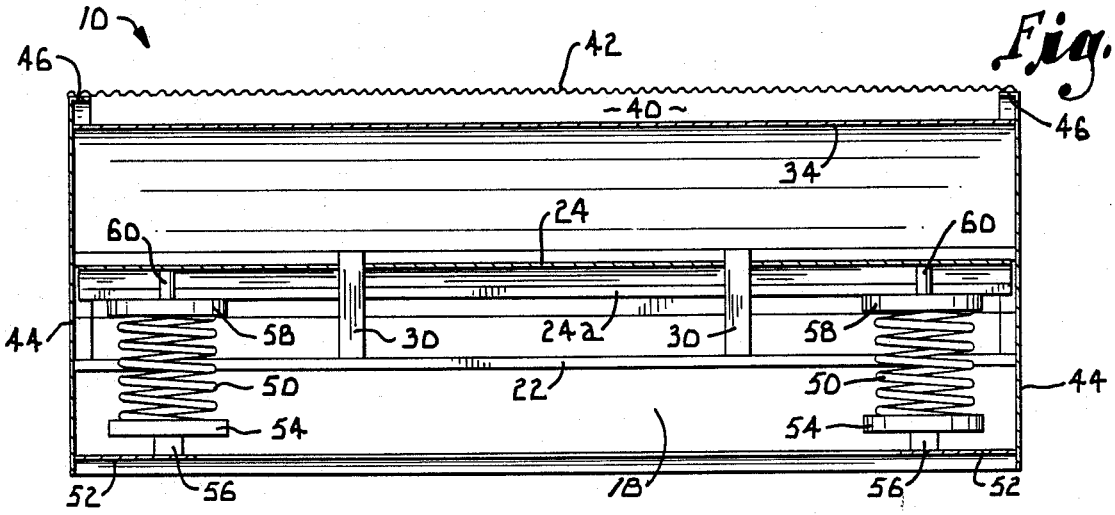
FIG. 4 is a sectional view taken generally along line 4—4 of FIG. 3 in the direction of the arrows.

However, when the temperature of the springs is raised to 95° F., the springs immediately expand to the expanded condition shown in FIGS. 3 and 4. Expansion of tee springs raises the damper 24 from its seated position on the edges 22, and the damper is then displaced from its seat and is maintained by springs 50 in its open position. Air from within the building is then vented into the inlet 20 and is able to bypass the damper 24 through the throat 26 and flow through passages 36 and out through opening 40 and screen 42.

When the springs 50 are thereafter cooled below 95° F., they begin to contract and somewhat slowly assume the contracted position again. Because of the characteristics of the shape-memory alloy, the springs 50 become fully contracted only after their temperature has dropped to approximately 86° F. Then, the damper 24 is fully closed on its seat, and ventilation through the housing is again cut off. The weight of the damper 24 assists in the lowering of the damper onto its seat as the springs contract.

The springs 50 expand rather suddenly but contract more slowly due to the characteristics of the shape-memory alloy. Thus, the damper 24 opens abruptly when the temperature rises to 95° F., and it closes more slowly as the springs cool below 95° F. While the springs are cooling from 95° F. to 86° F., the damper 24 is partially opened and allows some ventilation but less than when the damper is fully opened.

It is noted that chemical processes rather than mechanical forces cause the springs 50 to expand and contract. Consequently, metal fatigue is not a significant problem and the springs can function indefinitely without breakdowns or other malfunctions. There are no other moving parts that are subject to any wear, and the spring powered actuator thus has an extended operating life. This is particularly important because of the inaccessible location of the ridge vent 10 in most installations.

It is also noted that the springs 50 act automatically in response to the temperature level they sense, so there is no need for human involvement in the opening and closing of the damper. The damper is automatically opened when the air temperature within the building rises to a level that requires venting, and the damper remains closed when the building temperature is so cool that there is no need for venting. Consequently, energy is not wasted because the damper remains closed in cool weather and does not vent heated air which would add to the heating requirements of the building.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a ridge vent of the type having a roof mounted housing presenting an air passage therethrough for receiving air from within a building and discharging the air from the building through the roof, the improvement comprising:

a damper in the housing having an open position wherein the passage is open to air flow and a closed position wherein air flow through the passage is blocked by the damper;

an expansible and contractible spring in said housing having expanded and contracted conditions, said spring being constructed of a shape-memory alloy formed in a manner to assume said contracted condition of the spring below a predetermined temperature of the spring and to assume abruptly said expanded condition of the spring above said predetermined temperature of the spring; and means for coupling said spring with said damper in a manner to effect the closed position of the damper when said spring assumes said contracted condition and the open position of the damper when said spring assumes said expanded condition.

2. The improvement of claim 1, wherein said coupling means comprises:

means for mounting said spring on the housing with the spring oriented to expand in a substantially vertical direction from the contracted condition to the expanded condition; and means for mounting said damper on said spring for generally upward movement from the closed position to the open position when the spring assumes the expanded condition.

3. The improvement of claim 2, wherein said spring comprises a coil spring.

4. In a ridge vent having a roof mounted housing, an air passage in the housing, an inlet to the passage for receiving air from within the building, a damper seat adjacent the inlet, an outlet for the passage for discharging air from the housing, and a damper movable linearly in the housing toward and away from the seat between closed and open positions to respectively close and open the passage, the improvement comprising:

a pair of expansible and contractible coil springs each having expanded and contracted conditions and each having upper and lower ends, each spring being constructed of a temperature sensitive shape-memory alloy formed to effect the contracted spring condition when the spring temperature is below a predetermined level and to effect abruptly the expanded spring condition when the spring temperature is above said predetermined level;

means for mounting said damper on the upper ends of said springs; and means for mounting said springs in the housing at spaced apart locations wherein the springs are effective to maintain said damper on the damper seat in the closed position when the springs are in the contracted condition and to raise the damper off of and above the seat to the open position when the springs are in the expanded condition.

5. The improvement of claim 4, wherein said mounting means for the springs comprises a mounting member on the housing for each spring and means for securing the lower end of each spring to the corresponding mounting member with the spring in a substantially vertical orientation.

6. A ridge vent for a building roof, comprising:

a housing adapted for mounting on the roof, said housing presenting a passage therethrough having an inlet for receiving air from within the building and an outlet for discharging air outside the building;

a damper seat in said passage;

a damper having a size and shape to block air flow through said passage when the damper is seated on said damper seat in a closed position of the damper;

a pair of expansible and contractible springs each having an expanded condition and a retracted condition, each spring being constructed of a temperature sensitive shape-memory alloy formed to effect said contracted condition of the spring at a temperature below a predetermined temperature and to effect abruptly said expanded condition of the spring at a temperature above said predetermined temperature;

means for mounting said springs in said housing at spaced apart locations; and means for mounting said damper on said springs in a manner and at a location to maintain the damper in its closed position in the contracted condition of the springs, said damper being raised relatively rapidly by the springs when the latter assumes the expanded condition thereof to a fully open position wherein the damper is displaced from said seat to allow air flow through said passage.

* * * * *